US005284077A

United States Patent [19]

Ellis

[11] Patent Number: 5,284,077

[45] Date of Patent: Feb. 8, 1994

[54] DOBRO CAPO

[76] Inventor: Ted B. Ellis, 21910 Miller Bay Rd., Poulsbo, Wash. 98370

[21] Appl. No.: 964,927

[22] Filed: Oct. 22, 1992

[51] Int. Cl.[5] ..... G10D 3/00

[52] U.S. Cl. ..... 84/318

[58] Field of Search ..... 84/318, 453

[56] References Cited

U.S. PATENT DOCUMENTS

| | | | |
|---|---|---|---|
| 3,933,077 | 1/1976 | Dunlop | 84/318 |
| 4,143,576 | 3/1979 | Nichols | 84/318 |
| 4,671,156 | 6/1987 | Hathcock | 84/318 |

*Primary Examiner*—Michael L. Gellner
*Assistant Examiner*—P. Stanzione

[57] ABSTRACT

A capo for an instrument having a plurality of strings elevated above a fingerboard such as a dobro or Hawaiian guitar. The capo has an assembly of a spacer member partially enclosing a rotatable string-support member, both of which slide between the strings and the fingerboard, said spacer member having a recess underneath it for fret clearance, and said string-support member having a rounded tip. The spacer member and string-support member assembly being the same or slightly higher in elevation than the strings on a dobro type instrument, the rounded tip and fret recess enables sliding the assembly under the strings directly over a fret, while allowing room for pitch adjustment within the fret recess. There are protrusions from the bottom of the spacer member which contact the side of the instrument neck, and/or fingerboard, functioning as a stop when the assembly is slid into position. Attached to the string-support member is a rigid frame member, part of which is covered by a damper-retainer member composed of a resilient rubber or plastic material. Attached to the frame member is a securing means which engages the damper-retainer member to the strings with some pressure, thereby damping the strings between the string-support member and the nut, and in anchoring the strings maintaining string spacing and preventing string rattle on the string-support member.

20 Claims, 2 Drawing Sheets

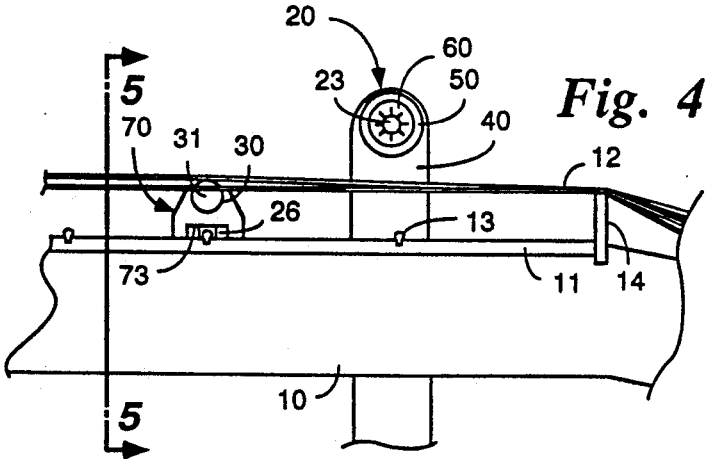
Fig. 4
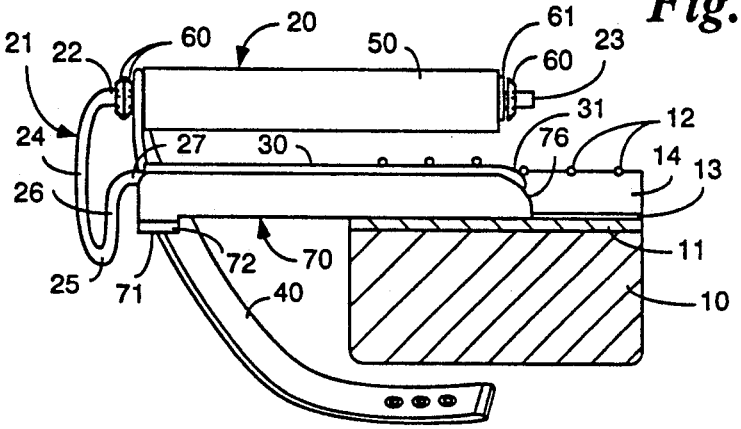
Fig. 5
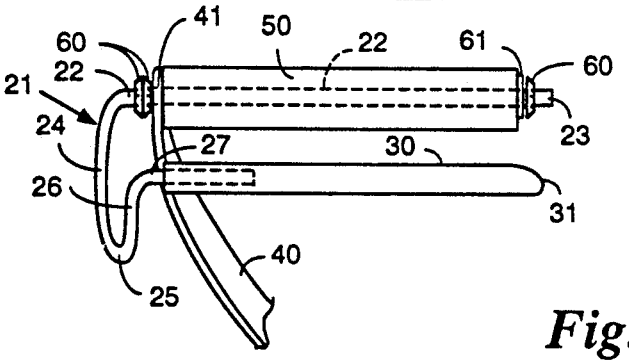
Fig. 6
Fig. 7
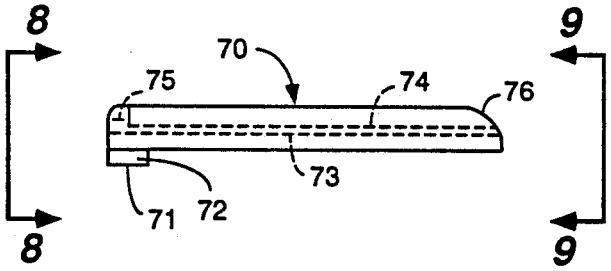
Fig. 8
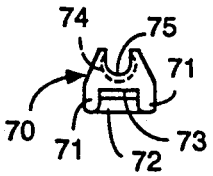
Fig. 9
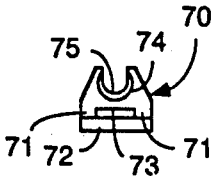
Fig. 10
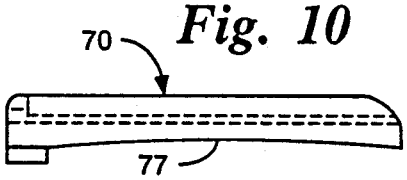

DOBRO CAPO

BACKGROUND

1. Field of Invention

This invention relates generally to capotasto devices for uniformly changing the pitch of all strings on a guitar simultaneously. More specifically it acts as a capo for a musical instrument with elevated strings such as a dobro or Hawaiian guitar.

2. Description of Prior Art

Capos are generally known for their application to guitars as an apparatus to uniformly raise the pitch of all the strings by clamping them directly in contact with the fingerboard, thereby engaging the strings onto a desired fret. These types of capos are typically represented by U.S. Pat. No. 390,612 to Moffat (1888), U.S. Pat. No. 1,788,636 to Russell (1927), U.S. Pat. No. 4,143,576 to Nichols (1979), and U.S. Pat. No. 4,583,440 to Myerson (1986). These designs are impractical for use on the typical dobro which has elevated strings, and is not fretted like a guitar, but is played using a solid slide bar. The dobro is generally held in a "flat" position with the neck and strings roughly perpendicular to the player's body. The player brings the slide bar into contact with the strings at a desired place with one hand, using the frets on the fingerboard as a positioning guide while plucking or strumming the strings with the other hand. This differs from a conventional guitar where strings are pressed into contact with frets to determine the pitch of the notes played.

The typical dobro also has some of its strings tuned to a higher pitch than a conventional guitar, thus making the strings more rigid and placing greater stress on the neck of the instrument. This stress is often dealt with by placing a stronger, "square" neck on the instrument, rather than the typical round style neck found on guitars.

A prior art capo for a dobro is represented by U.S. Pat. No. 4,671,156 to Hathcock (1987). This type of device clamps from above and below the strings above the desired fret, "hanging" onto the strings above the fingerboard.

One drawback is the obstruction it places on top of the strings. It is a common practice for the experienced player to hold the slide bar between the thumb, index and middle fingers. The thumb is in front of the bar (towards the body of the instrument), the index finger is on top, and the middle finger is behind the bar. The ring and little finger take up additional space behind the bar. These two fingers are often used to damp the strings behind the bar to eliminate string buzzing and overtones. When the structure of the capo extends above the fret being capoed to, it interferes with the player's middle, ring and little finger, as well as the slide bar, thus crowding and inhibiting movement.

Another unwanted effect occurs when the strings behind the capo (between the capo and the nut), begin to vibrate, creating undesirable overtones. The strings behind the capo vibrate during play, without being touched directly, by picking up the sound produced by the instrument through the air, the neck, the strings, and the capo itself.

A third problem occurs when one or more of the strings, for whatever reason, goes out of tune while the capo is attached. The capo clamps on tightly enough so that the strings do not react predictably when being adjusted by a tuning machine with the capo on. After adjusting a string or strings, they tend to continue stretching or contracting out of tune, while being played as they "settle in", under the pressure of the capo. This often creates a situation of tuning and retuning without satisfactory results. A player may then find it necessary to remove the capo, retune the instrument, and then reattach the capo, resulting in considerable time being wasted.

Another problem with the tight clamping effect of these types of capos is that if they are not clamped to the desired position accurately, they must be unclamped, repositioned, and then reclamped. The tight clamping forces prevent moving them easily (by sliding), to make slight adjustments in accurately setting the pitch. These types of capos also pinch the strings directly against a hard surface, flattening the windings, and otherwise damaging the strings.

There is also a muffling of the tonal quality from the suspended nature of the capo. The nut of an instrument helps in transferring the sound from the strings to the neck and on to the body of the instrument. This cannot be accomplished with a suspended type of capo. These capoes also move vertically, while the instrument is being played, since they "hang" from the strings and are not supported by the neck. The string bounce that this allows is undesirable to the player.

Another prior art is shown in U.S. Pat. No. 3,933,077 to Dunlop (1976). This device has a spacer member under the strings, with a pressure member above the strings that engages the strings to the spacer member by means of an elastic strap. The spacer member may have grooves to accommodate the strings.

As previously mentioned, dobro fingerboards have frets for the player to use as guides for positioning the slide bar. Dunlop does not show these frets in the drawing where his device is being used as a capo for Hawaiian type guitars. These instruments do have frets, however, and as his other drawing shows, the device must be positioned to one side of a fret due to the design of the spacer member. This makes it fundamentally impossible for the capo to retune the instrument accurately in relation to the desired fret. In addition, it renders all of the other frets out of true position since the capo cannot be accurately aligned with its own fret. The various forms of the spacer member may also set the strings back even further from the fret being capoed to. The higher the elevation of the strings above the fingerboard, the larger the diameter of the spacer required, resulting in greater offsets from the capoed fret and producing a larger error in pitch. In addition, the string grooves in the spacer may not match the string spacing on the player's instrument, creating a situation where the player is readjusting to this spacing which can vary when the capo is attached and removed.

Another problem lies in the short leg of the U-shaped member. This object interferes with the players bar hand as it slants above the strings to connect to the pressure member. The bar hand is also cramped by the pressure member which is in very close proximity to the spacer member.

A further problem also occurs with the spacer member. The spacer is designed to slide under the strings across the fingerboard of a dobro type of guitar. Its cylindrical shape has a narrow surface which contacts the fingerboard, a sharp leading edge, and grooves for strings. Repeated sliding and pressing of these surfaces against the fingerboard will cause damage to the surface of the fingerboard.

As such, there is a need for a dobro capo which imitates the nut of the instrument in tonal quality but does not hamper the players bar hand movements, does not muffle the strings, allow undesirable overtones, place more than acceptable wear and tear on the instrument or its strings, and is easily attached and adjusted during play.

BRIEF SUMMARY, WITH OBJECTS AND ADVANTAGES OF THE INVENTION

This invention provides a capo for a dobro, said invention having an assembly of a spacer member containing a string support member on top, and a recess underneath the spacer member for placing the assembly over a fret between the strings and fingerboard of the dobro, with a detachable securing means for stabilizing and damping said strings.

Accordingly, there are several objects and advantages embodied in the present invention, which are:

(a) to provide a capo which does not interfere with the player's bar hand when executing slide bar movements;

(b) to provide a capo which does not alter the natural sound of the instrument, by functioning like the instrument's nut in transferring sound from the strings through the capo to the neck and body of the instrument;

(c) to provide a capo which is quickly and easily attached;

(d) to provide a capo which does not damage the surface of the instrument's fingerboard or the strings of the instrument;

(e) to provide a capo which may be moved, while attached, to make slight adjustments in pitch to all strings equally;

(f) to provide a capo which, while attached, permits accurate retuning of a string or strings by using the tuning keys without any "settling in" effects;

(g) to provide a capo which does not allow unwanted overtones to emit from the strings between the capo and the nut of the instrument;

(h) to provide a capo which does not move vertically, allowing unwanted string bounce while the instrument is played.

BRIEF DESCRIPTION OF DRAWINGS

FIG. 4 is a fragmentary side elevational view, taken generally along the line and in the direction of arrows 4—4 of FIG. 3.

FIG. 5 is a fragmentary, sectional view taken generally along the line and in the direction of arrows 5—5 of FIG. 4.

FIG. 6 is a front elevational view of an embodiment of this invention with the spacer member not shown.

FIG. 7 is a front elevational view of a first embodiment of the spacer member.

FIGS. 8 and 9 are end views of the spacer member taken generally along the lines and in the direction of arrows 8—8 and 9—9 respectively, from FIG. 7.

FIG. 10 is a second embodiment of the aforementioned spacer member.

REFERENCE NUMERALS USED IN DRAWINGS

| | |
|---|---|
| 10 | instrument neck |
| 11 | instrument fingerboard |
| 12 | instrument string(s) |
| 13 | instrument fret(s) |
| 14 | instrument nut |
| 15 | tuning key(s) |
| 16 | headstock |
| 20 | capo embodiment |
| 21 | frame member |
| 22 | upper frame segment |
| 23 | end of upper frame segment |
| 24 | long vertical frame segment |
| 25 | lower curved frame segment |
| 26 | short vertical frame segment |
| 27 | lower frame segment |
| 30 | string-support member |
| 31 | tip of string-support member |
| 40 | securing means |
| 41 | eyelet holes |
| 50 | string damper-retainer member |
| 60 | stop nut(s) |
| 61 | washer |
| 70 | spacer member |
| 71 | spacer member neck stop |
| 72 | neck protector |
| 73 | spacer member fret recess |
| 74 | string-support member cavity |
| 75 | clearance groove |
| 76 | tip of spacer member |
| 77 | curve adaptation |

DETAILED DESCRIPTION OF DRAWINGS

Figure 1:
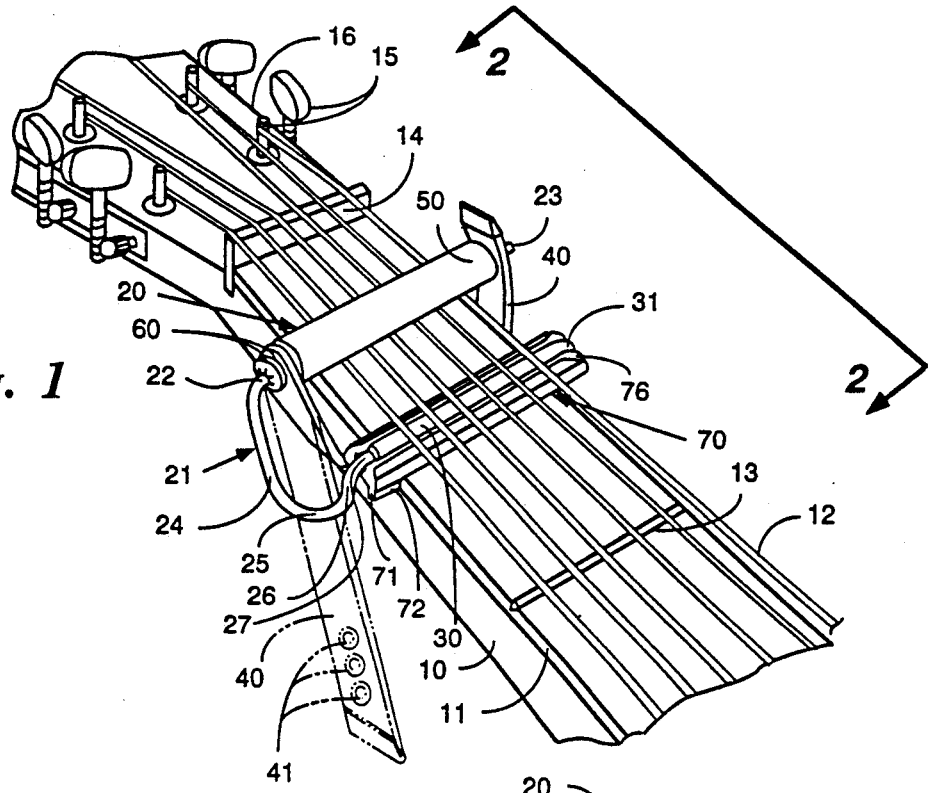
FIG. 1 is a fragmentary, perspective view of the neck of a stringed instrument employing elevated strings such as a dobro, with the apparatus of this invention mounted thereon.

Referring now to FIG. 1, there is shown a fragmentary perspective view of the neck of a six-stringed instrument with elevated strings representative of a typical dobro. The body of the neck 10 is of the "square" type used for added rigidity. A plurality of strings 12 are spaced equally above a fingerboard 11, and are elevated considerably (in comparison to a typical guitar) above frets 13 by a nut 14, said strings terminating at tuning keys 15 mounted on headstock 16.

The embodiment of the capo, generally designated 20 has a frame member 21 consisting of an upper frame segment 22, the end of the upper frame segment 23, a long vertical frame segment 24, a lower curved frame segment 25, a short vertical frame segment 26, and a lower frame segment 27.

Referring now to FIG. 6, starting from the left side of the upper frame segment 22 and moving to the right, the frame segment 22 passes through two stop nuts 60, a securing means 40 in the form of an elastic strap with an eyelet 41, a string damper-retainer member 50 composed of a sufficiently resilient material such as rubber or plastic, a washer 61 and another stop nut 60 from which projects the end of the upper frame segment 23. With reference now to the long lower frame segment 27, it extends into the left side of the string-support member 30 and may be affixed there by means of an adhesive or a pressed interference fit. The right side of the string-support member 30 ends in a tapered radius tip designated 31.

Referring now to FIGS. 7, 8 and 9, these illustrate three views of the spacer member 70, made of plastic or some other durable material, from the bottom of which projects two neck stops 71, attached to which is a neck protector 72 (to prevent scarring the neck 10 and/or fingerboard 11), consisting of a resilient material such as rubber or fabric attached by adhesive. There is a fret recess 73 allowing ample clearance for a fret beneath it. 74 is a cavity into which fits the string-support member 30 (shown in FIG. 6). The cavity 74 is sized to fit the string-support member 30 snugly, while allowing said member to rotate within said cavity with some resistance. There is a clearance groove 75 for the lower frame segment 27 (which can be seen assembled in FIG. 3). In FIG. 5 the spacer member 70 has a tip 76 which is tapered and curved and lies below the similarly shaped string-support member tip 31.

FIG. 10 illustrates a second embodiment of the aforementioned spacer member 70 with a modification in the form of a curved adaptation surface 77.

OPERATION OF THE INVENTION

Figure 3:
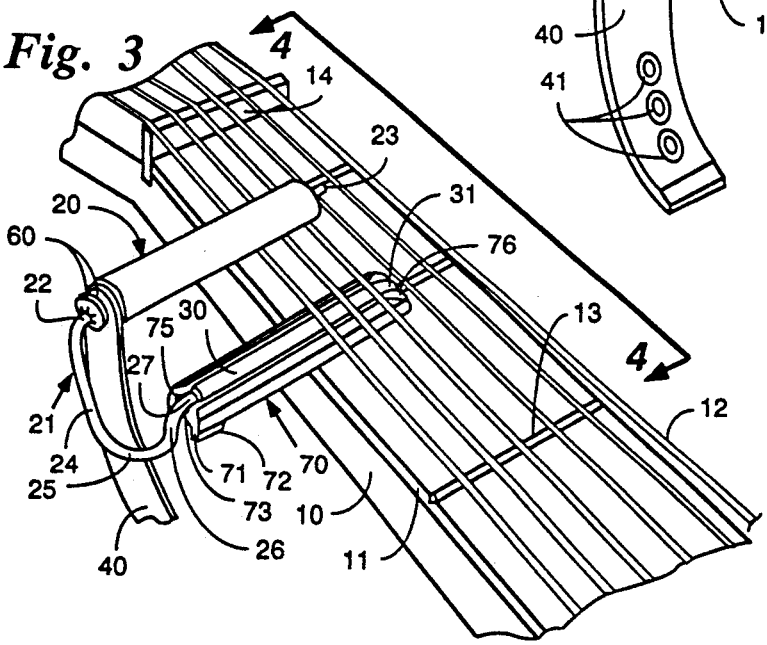
FIG. 3 is a view similar to FIG. 1, but illustrating the capo in a partially installed position.

To place the capo 20 in use, the spacer member 70 containing the string-support member 30 is placed over the desired fret 13 between the fingerboard 11 and the strings 12, and with the string damper-retainer member 50, positioned above said strings, the spacer member is slid across said fingerboard beneath said strings. The damper-retainer member 50 remains in a clearance position above the strings 12 to prevent contacting said strings as the capo 20 is slid into position. In FIG. 3, 4 and 5 the capo 20 is shown in a partially installed position as described in the procedure above.

The spacer member 70 and string-support member 30 are constructed so that said string support-member 30 is positioned at the same height or slightly higher than the instrument's strings 12. FIG. 5 illustrates the slight lifting action on the strings 12 as they come into contact with the string-support member tip 31. The shaped tip 31 provides for easy installation of the capo 20 with a design that puts the point of the tapered tip 31 below the strings 12 of the instrument. FIG. 4 shows how the spacer member recess 73 clears the fret 13 that it is placed over, with room for some movement up or down the length of the fingerboard 11 while positioned above said fret.

Figure 2:
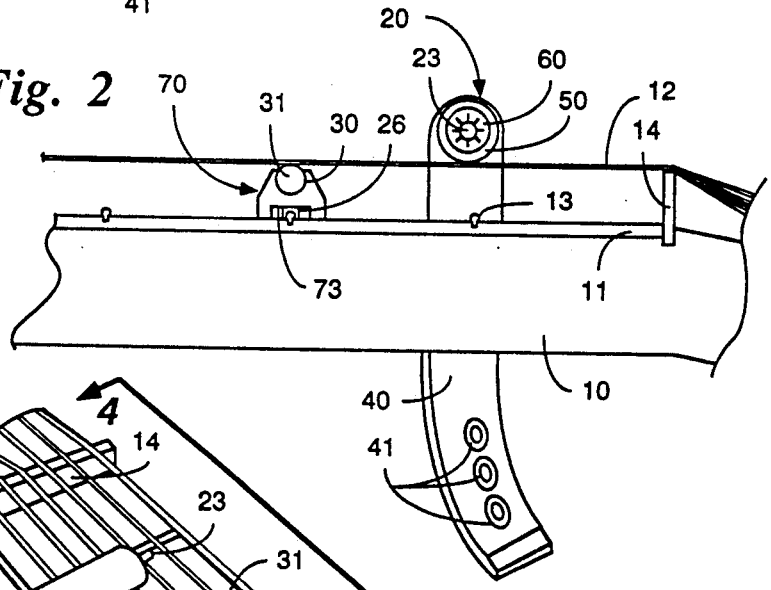
FIG. 2 is a fragmentary side elevational view taken generally along the line and in the direction of arrows 2—2 of FIG. 1, but illustrated with the securing member in an unfastened position.

The capo 20 is slid in a continuous motion across the fingerboard 11, as described previously, until the neck protector 72 comes into contact with the neck 10 of the instrument. The string damper-retainer member 50 is then moved downward into contact with the strings 12 as shown in FIG. 2 (and in FIG. 1, with the dotted lines representing the securing means 40). The frame member 21, shown in FIG. 1, positions the damper-retainer member 50 as shown in FIG. 2 just in front of the fret 13 preceding the capo 20. This spacing of the upper frame member 22 and the lower frame member 27 would allow the spacer member 70 to be placed over the first fret 13 of an instrument, and provides room for the string damper-retainer member directly in front of the nut of an instrument. The securing means 40, shown in the form of an elastic strap, is then grasped and wrapped beneath the neck and secured by placing one of the eyelets 41 over the end of the upper frame segment 23 as shown in FIG. 1, thereby bringing the damper-retainer member 50 into firm contact with the strings 12. There are several eyelets 41 available to provide the sufficient tension needed for varying neck sizes, including instruments with round necks.

The required force applied by the damper-retainer member 50 via the securing means 40 to the strings 12 is minimized since said strings are already in firm contact with the string-support member 30 due to the lifting action mentioned earlier.

The functions of the damper-retainer member 50 are as follows: (1) to hold the strings immobile where they contact the damper-retainer member, thereby maintaining the equal spacing between the strings as they are being played; (2) to prevent said strings from rattling on the string-support member 30 during play; (3) to dampen said strings between the damper-retainer member and the nut 14, thereby preventing unwanted overtones from occurring; and (4) to place the damper-retainer member as far from the string-support member as possible to allow the player maximum movement around the fret to which it is being capoed.

Referring to FIG. 1, projecting from the left side of the string-support member 30 is the lower frame member 27 which extends downward therefrom as the short vertical segment 26, which places said segment 26, as well as the curved segment 25 and the long vertical segment 24, out of the way of a player's bar hand movements.

The capo 20 is now attached, and with the spacer member 70 centered over the fret 13, the instrument will be properly tuned to that position. The spacer member 70 (in combination with the string-support member 30) acts as a "nut", transferring sound more effectively to the neck and body of the instrument than "hanging" types of capos.

Often guitars, banjos and other instruments do not tune accurately when capoed (they tend to raise the pitch of all strings noticeably due to the clamping force of their capos stretching the strings), and other instruments adjust to match them. Proper tuning is easily accomplished with the dobro capo 20, as described here. To raise or lower the pitch of all strings uniformly, it is simply moved up or down the fingerboard 11, over the fret it is positioned, within the room provided by the fret recess 73. This can be done with the capo 20 in the secured position, since the damper-retainer member 50 is not clamping the strings 12 directly to the string-support member 30, inhibiting movement. This also allows the individual adjustment of the strings using the tuning keys 15. Thus minor, accurate adjustments to pitch are quickly and easily resolved.

FIG. 10 shows a modified embodiment of the spacer member 70, with a curved adaptation surface 77, designed to fit instruments having a rounded fingerboard.

This capo embodies a combination of unique features that distinguish it from other capoes.

(a) It is a capo which does not impede a player's bar hand movement for the following reasons. The string-support member's lifting action of the strings allows for easy string stabilization by the damper-retainer member, since the strings are supplying their own pressure on the string-support member. This, along with the fret straddling design of the spacer member, eliminates the need for the string damper-retainer member to be positioned close to the string-support member to stabilize the strings. Instead the string damper-retainer member is situated as far towards the nut of the instrument as possible. This arrangement, along with having the frame member segments below the level of the strings, affords the player the greatest possible clearance behind the capo for bar hand movement.

(b) The spacer member and string-support member mimic the function of an instrument's nut in the transfer of sound to the neck and body of the instrument, and when stabilized by the string damper-retainer sleeve creates ideal sound production.

(c) Installation is performed quickly and easily due to the rounded tip on the string-support member, the positioning neck stops, and the adjustable elastic strap.

(d) It causes no wear and tear on the strings or instrument since there is no direct clamping of the strings against a hard surface, and the spacer member is composed of a material which will not damage the fingerboard.

(e) The indirect clamping allows the capo to be moved up and down the fingerboard slightly while positioned over a fret, to make pitch adjustments to all strings uniformly when needed without unclamping the capo.

(f) indirect clamping also allows for individual string adjustments using the tuning keys without any "settling in" effects.

(g) There are no unwanted sounds emitted from the strings between the string-support member and the instrument nut due to the effect of the damper-retainer member.

(h) There is no string bounce while playing, as found in "hanging" type capos, since the strings are capoed solidly to the fingerboard by the string-support member and the spacer member.

(i) The capo tunes accurately when installed since it mounts directly over a fret.

From the preceding this invention will be seen to be one that achieves the ends and objects set forth herein, along with other advantages which are obvious and inherent to the structure. Although the description above contains many specifications, these should not be construed as limiting the scope of the invention, but as merely providing illustrations of some of the presently preferred embodiments of this invention. For example, the damper-retainer member could be of a different shape, such as a bar with a flat resilient material attached; the string support member and spacer member could be a one piece design; etc.

It will be understood that certain features and subcombinations are of utility and may be employed without reference to other features and subcombinations. This is contemplated by and is within the scope of the claims.

Thus, since many possible embodiments may be made of the invention without departing from the scope thereof, it is to be understood that all matter herein set forth or shown in the accompanying drawings is to be interpreted as illustrative and not in a limiting sense.

I claim:

1. A capo for a dobro or similar instrument having a plurality of strings elevated above a fretted fingerboard, said capo being composed of:

a string-support member and spacer member for sliding between said strings and said fingerboard over a selected fret, said spacer member having a recess underneath for sliding said spacer member over said fret, and said spacer member containing said string-support member.

2. The capo as defined in claim 1, wherein a rigid frame member operatively associated with said string-support member has mounted onto said frame member a string damper-retainer member for applying pressure over said strings, and a securing means for applying said pressure.

3. The capo as defined in claim 2, wherein said string-support member is rotatable within said spacer member.

4. The capo as defined in claim 3, wherein the height of said spacer member and said string-support member are approximately equal to, or slightly greater in height than said strings above said fingerboard, said string-support member having a tapered tip, which urges strings upward onto its top surface during installation.

5. The capo as defined in claim 4, wherein said frame member projects downward from said string-support member, then extends laterally towards said nut while being generally parallel to said neck, then extends vertically and generally perpendicular until it is above said strings, then extending generally parallel to said string-support member across said strings, where the distance between said string-support member and said frame member is slightly less than the distance between said nut and the center of the first said fret.

6. The capo as defined in claim 5, wherein said frame member has mounted thereon a damper-retainer member consisting of a sleeve of generally cylindrical resilient material, and a securing means in the form of an elastic strap for engaging said damper-retainer member to said strings.

7. The capo as defined in claim 6, wherein said spacer member is composed of a plastic or other suitable material which does not damage the surface of the instrument's fingerboard.

8. The capo as defined in claim 6, wherein said spacer member has a downward projection on one end which contacts the side of said neck and/or said fingerboard, thereby providing proper lateral positioning of said capo.

9. The capo as defined in claim 7, wherein said spacer member has a downward projection on one end which contacts the side of said neck and/or said fingerboard, thereby providing proper lateral positioning of said capo.

10. The capo as defined in claim 3, wherein said spacer member has a curved surface adapted to seat in a stable manner on an instrument having a rounded fingerboard.

11. A capo for a dobro or similar instrument having a plurality of strings elevated above a fretted fingerboard, said capo being composed of:

a string-support member and spacer member for sliding between said strings and said fingerboard over a selected fret, said spacer member having a recess underneath for sliding said spacer member over said fret, and said spacer member containing said string-support member;

a rigid frame member operatively associated with said string-support member which has mounted onto said frame member a string damper-retainer member for applying pressure over said strings, and a securing means for applying said pressure; and wherein said frame member projects downward from said string-support member, then extends laterally towards said nut while being generally parallel to said neck, then extends vertically and generally perpendicular until it is above said strings, then extending generally parallel to said string-support member across said strings, where the distance between said string-support member and said frame member is slightly less than the distance between said nut and the center of the first said fret.

12. The capo as defined in claim 11, wherein said frame member has mounted thereon a damper-retainer member consisting of a sleeve of generally cylindrical resilient material, and a securing means in the form of an elastic strap for engaging said damper-retainer member to said strings.

13. The capo as defined in claim 12, wherein said spacer member has a downward projection on one end which contacts the side of said neck and/or said fingerboard, thereby providing proper lateral positioning of said capo.

14. The capo as defined in claim 13, wherein said spacer member has a curved surface adapted to seat in a stable manner on an instrument having a rounded fingerboard.

15. A capo for a dobro or similar instrument having a plurality of strings elevated above a fretted fingerboard, said capo being composed of:

A string support-spacer member for sliding between said strings and said fingerboard over a selected fret, said member having a recess underneath for sliding said member over said fret, and a tapered tip on the end of said member for urging said strings upward onto its top surface during installation.

16. The capo as defined in claim 15, wherein the height of said string support-spacer member is approximately equal to, or slightly greater in height than said strings above said fingerboard.

17. The capo as defined in claim 16, wherein said frame member projects downward from said string support-spacer member, then extends laterally towards said nut while being generally parallel to said neck, then extends vertically and generally perpendicular until it is above said strings, then extending generally parallel to said string support-spacer member across said strings, where the distance between said string support-spacer member and said frame member is slightly less than the distance between said nut and the center of the first said fret.

18. The capo as defined in claim 17, wherein said frame member has mounted thereon a damper-retainer member consisting of a sleeve of generally cylindrical resilient material, and a securing means in the form of an elastic strap for engaging said damper-retainer member to said strings.

19. The capo as defined in claim 18, wherein said spacer member has a downward projection on one end which contacts the side of said neck and/or said fingerboard, thereby providing proper lateral positioning of said capo.

20. The capo as defined in claim 19, wherein said spacer member has a curved surface adapted to seat in a stable manner on an instrument having a rounded fingerboard.

* * * * *